United States Patent [19]

Moritz et al.

[11] Patent Number: 4,747,714

[45] Date of Patent: May 31, 1988

[54] MECHANISMS FOR SELECTIVELY RAISING AND TRANSPORTING PRINT RIBBONS AND CORRECTION TAPES

[75] Inventors: Manfred Moritz, Nuremberg; Wilfried Rettke, Altodorf, both of Fed. Rep. of Germany

[73] Assignee: Ta Triumph-Adler Aktiengesellschaft, Nuremberg, Fed. Rep. of Germany

[21] Appl. No.: 925,231

[22] Filed: Oct. 31, 1986

[30] Foreign Application Priority Data

Nov. 11, 1985 [DE] Fed. Rep. of Germany ..... 3539443

[51] Int. Cl.[4] ..... B41J 35/22

[52] U.S. Cl. ..... 400/214; 400/231; 400/697.1

[58] Field of Search ..... 400/695, 697, 697.1, 400/211, 212, 214, 216, 216.1, 216.2, 216.4, 216.5, 216.6, 223, 231

[56] References Cited

U.S. PATENT DOCUMENTS 4,247,210 1/1981 Kacmarcik et al. ..... 400/236.1
4,329,072 5/1982 Kacmarcik et al. ..... 400/697.1
4,472,073 9/1984 Valle et al. ..... 400/697.1
4,502,802 3/1985 Kuzuya ..... 400/695

FOREIGN PATENT DOCUMENTS 3208605 9/1983 Fed. Rep. of Germany .
0215888 12/1984 Japan .

*Primary Examiner*—Edgar S. Burt
*Assistant Examiner*—James A. Lisehora
*Attorney, Agent, or Firm*—Browdy and Neimark

[57] ABSTRACT

Function controlled raising and transporting mechanism for the selective control of a print ribbon or correction tape by means of a power drive and freewheeling clutches operative to effect print ribbon or correction tape transport incident to carriage motion in print direction only. In certain commanded functions such as spacing, tabulating, etc., both the print ribbon and correction tape transports are disabled by moving output elements of the freewheeling clutches to intermediate clutch disabled positions to thereby realize optimum utilization of the ribbon and tape capacities.

5 Claims, 2 Drawing Sheets

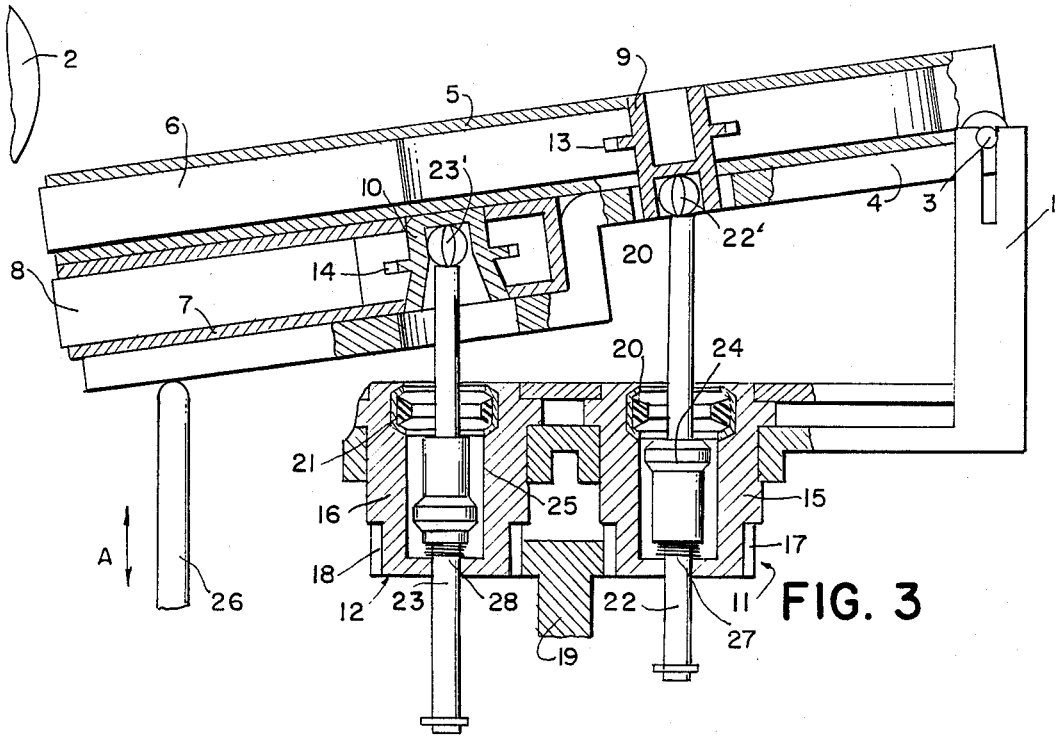
FIG. 3
FIG. 4
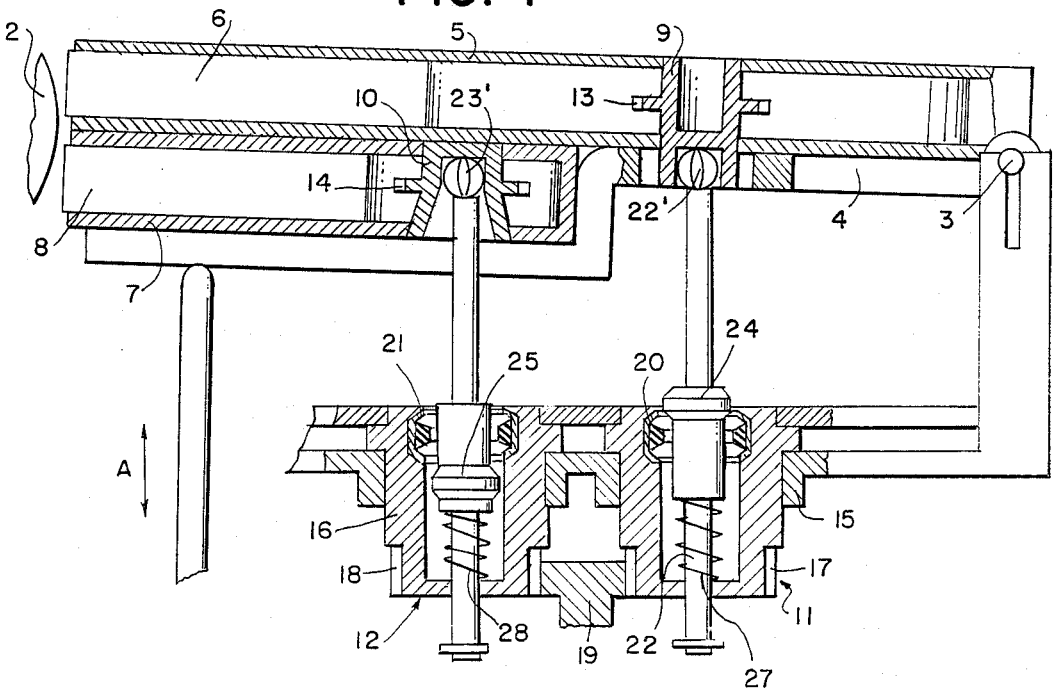

MECHANISMS FOR SELECTIVELY RAISING AND TRANSPORTING PRINT RIBBONS AND CORRECTION TAPES

This invention relates to mechanisms for selectively raising and transporting print ribbons and correction tapes.

In electronically controlled typewriters, a print ribbon as well as a correction tape can be driven alternately. This means that either the print ribbon or the correction tape can be raised from a position of rest to the level of a record carrier line to be typed. Each reproduction of a character on either the ribbon or the tape must be followed by a transport step for the ribbon or tape, respectively. Gear drives followed by a freewheeling clutch, for example, have proven to be most satisfactory for the transport of print ribbon and correction tape. As the action of freewheeling clutches depends on the direction of rotation, ribbon is transported only incident to rotation in typing direction.

The transport of the correction tape is often effected via a pawl engaging a ratchet wheel, thereby turning the take-up spool of the correction tape by a predetermined angular distance. In the devices described above a transport step is basically made, at least for the print ribbon, whenever the type element carriage is being moved in a clearly defined direction, e.g., the typing or print direction. This means that the ribbon is also being transported during spacing, tabulating, or paragraph indenting, for instance. These ribbon transport motions without typing on the ribbon result in unnecessary ribbon consumption. Depending on the nature of the text to be typed this useless consumption can add up to a considerable part of the total available ribbon length.

In accordance with the invention print ribbon and correction tape transport means are automatically selectively enabled and disabled according to selected function to avoid unnecessary ribbon consumption and to realize optimal utilization of print ribbon and tape over their entire capacity. A desiderata is to provide, with a minimum of additional parts, mechanism operable to automatically enable correction tape transport when the correction tape is raised to the typed line level while at the same time disabling the print ribbon transport.

The desiderata are accomplished by employing known freewheel or overrunning clutches. Overrunning or freewheeling clutches are normally engaged in one (that is, power transmitting) direction of rotation and freewheel in the opposite direction. In such clutches, balls or rollers positioned between drive and driven parts are, in the power transmission direction, wedged between the drive and driven parts, and the latter is frictionally driven via the wedged rollers. Springs bias the rollers opposite the power transmission direction to effect the wedging of the frictional coupling. In accordance with the invention the freewheel clutches, while normally engaged in the power transmitting direction, may be enabled or disabled by axial movement of the clutch output parts incident to the movement of a ribbon cassette supporting platform, to selected elevated positions for presenting ribbon or tape for printing.

An object of the invention is to automatically couple power to effect transport of print ribbon or correction tape, or neither, incident to movement of a ribbon and tape support platform to selected elevated positions at which print ribbon or correction tape, or neither, is presented for printing.

Other objects, features and advantages of the present invention will become better known to those skilled in the art, from a reading of the following detailed description when taken in conjunction with the accompanying drawings, wherein like reference numerals designate like or corresponding elements throughout the several views thereof, and wherein:

FIG. 3 is a view similar to FIGS. 1 and 2, showing the mechanism moved to the rest position wherein the operator of the typewriter can see the inverted line on the platen, with the print ribbon and correction tape being lowered below the print line.

FIG. 4 is a similar view, showing the mechanism moved to the intermediate position, at which neither the correction tape nor the print ribbon is driven.

Figure 1:
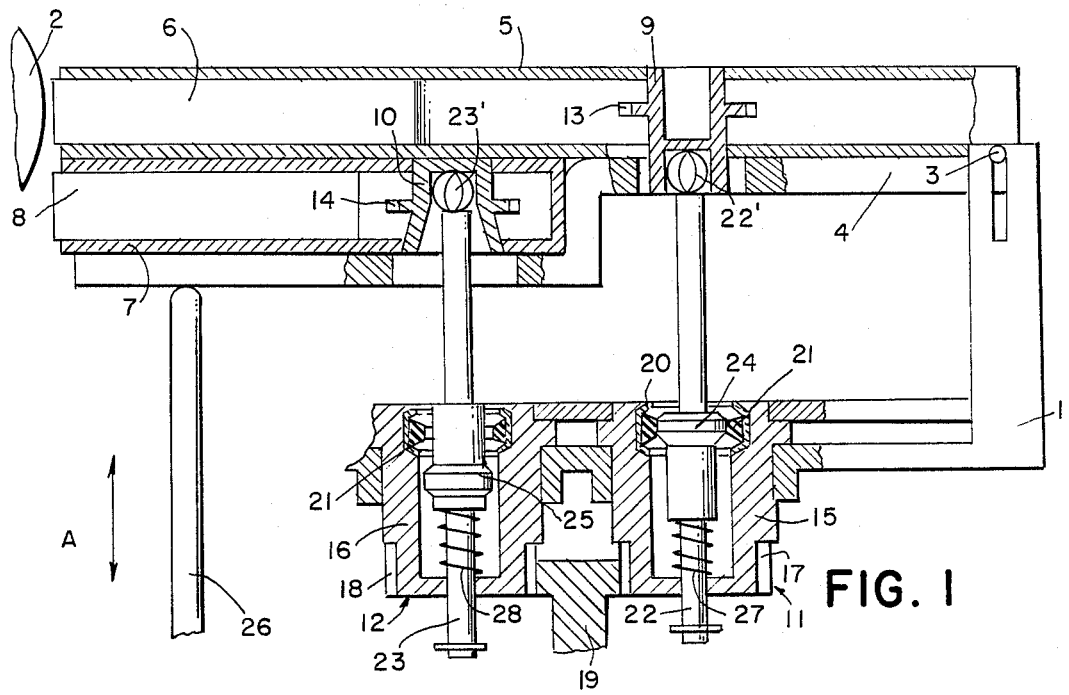
FIG. 1 is a transverse sectional view showing the mechanism moved to a first elevated position with the print ribbon opposite a typed line level.

Referring now to the drawings, there is shown a typewriter carriage 1 which is movable along guide rails (not shown) parallel to a platen 2. Disposed on the carriage 1, which may support a type element such as a rotatable typewheel, is a stepped cassette deck or platform 4 supported so as to be pivotable about a bearing 3. A cassette 5 equipped with a ribbon 6, and a cassette 7 with a correction tape 8, are adapted to be mounted on the stepped platform 4 with the correction tape cassette 7 below the ribbon cassette 5. The transport of ribbon 6 and tape 8 is effected by transport wheels 9 and 10, respectively, which are rotatably mounted in the respective cassettes 5 and 7, and which are detachably coupled in a manner yet to be described to output parts of overrunning or freewheeling clutches 11 and 12, respectively. On the outer periphery of the transport wheels 9 and 10, respectively, teeth 13 and 14 are provided to engage the periphery of and to wind the ribbon 6 and tape 8 on associated take-up spools, thereby to move or transport ribbon or tape to present fresh ribbon or tape at a printing point.

As shown in FIG. 1 the freewheeling clutches 11 and 12 are mounted to the carriage 1. The clutches consist of drive parts in the form of ring gears 15 and 16, respectively, each having a toothed rim 17, 18, respectively. In the embodiment shown, the toothed rims 17, 18 of the ring gears mesh with a rack 19 on a machine frame supporting the carriage whereby ring gears 15 and 16, respectively are turned while the carriage 1 is being moved along the platen 2 in one or the other direction. In a modification of this embodiment, the ring gears 17 and 18 could also be in positive engagement with a gear drivable by a separate motor.

The ring gears 15 and 16 are equipped with freewheels 20 and 21, secured internally thereof, respectively, which are known per se and therefore not detailed. It is noted, however, that both freewheeling clutches 11 and 12 are designed so that transport steps for the ribbon 6 as well as for the correction tape 8 can be transmitted while the carriage 1 is being moved in typing direction, i.e. into the plane of the drawing.

The freewheeling clutches 11, 12 each have an output part in the form of a shaft 22 and 23, respectively, which are movable axially. Each shaft 22, 23 at selected axial locations has a formation 24, 25 respectively. The formations 24, 25 are of larger diameter and, when the shafts 23, 24 are axially positioned, are brought into operative engagement with the freewheels 20 and 21. This enables the clutches, whereby the shafts 22, 23 will be driven incident to rotation of the drive parts 15 and 16 in the clutch engaged or power transmitting, (stated otherwise, in the typing) direction.

Figure 2:
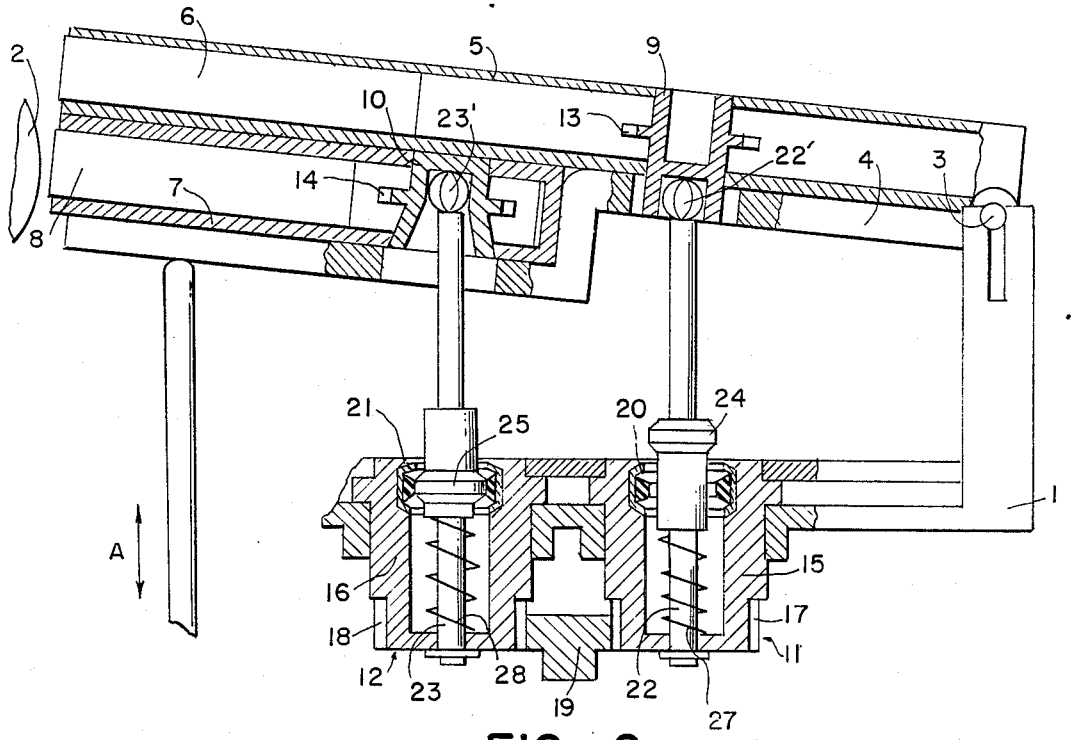
FIG. 2 is a view similar to FIG. 1 showing the mechanism moved to a second elevated position with the correction tape opposite the typed line level.

The cassette deck 4 together with the cassettes 5 and 7 can be selectively raised to first and second elevated positions as shown in FIG. 1 and FIG. 2 respectively, by means of a rod 26, movable in the direction of the double arrow A, e.g., by a cam plate or controlled drive mechanism. Indicated by the dotted lines in FIG. 1 is the position at rest in which the platform 4 is lowered so far below the positions shown that the typewriter operator has an unobstructed view of the line of typed text. Such ribbon and correction tape stroke controls are known per se in electronically controlled typewriters and therefore need not and are not here described in detail. The raising motion of the rod 26 is thus controlled automatically depending on the function put in by the operator e.g. print, correction, or indent, tab or space.

As hereinbefore noted, FIG. 1 shows the mechanism raised to a first elevated position such that the print ribbon 6 is at the typed line level and clutch 11 is enabled. In this elevated position, formation 24 on output shaft 22 of the freewheeling clutch 11 is in operative engagement with the rolls of the freewheel 20 so that, upon an appropriate motion of the carriage 1 in the print direction, the rotary motion of gear drive part 15 is transmitted to the output shaft 22 via the freewheel 20. Accordingly, a coupling element 22' at the upper end of shaft 22 designed to be detachably coupled to the hollow transport wheel 9, will turn the transport wheel 9 whose teeth 13 in turn engage the periphery of the wound take-up spool to transport and wind up ribbon 6 thereon.

In the FIG. 1 position of the rod 26, or of the cassette deck 4, the formation 25 on output shaft 23 of the freewheeling clutch 12 is below that area of the rolls of the freewheel 21 and the clutch 12 is disabled. It is accordingly evident therefrom that the rotary motion of the drive part 16 cannot be transmitted to the shaft 23 during motion of the carriage 1 in the print direction. Accordingly, the correction tape 8 is not transported in the FIG. 1 position of the cassette deck 4.

In FIG. 2 showing the platform 4 elevated to position the correction tape 8 at the typed line level, the freewheeling clutch 12 associated with the correction tape is shown enabled. This occurs when the rod 26 is raised to a second elevated position as shown, at which formation 25 is operatively engaged with the rolls of the freewheel 21 so that the rotary motion of the drive gear 16 in the power transmitting direction can be transmitted to shaft 23, and via its coupling part 23' to transport wheel 10. This transmission now brings about the transport step for the correction tape 8 by means of the rotation of transport wheel 10 and engagement of its teeth 14 with the wound correction take-up spool. Each one of the shafts 22, 23 is affected by the action of a surrounding coiled spring 27, 28, respectively. The two springs tend to push the shafts 22 and 23 axially upwardly. This assures that the coupling parts 22' and 23' on the ends thereof are kept in coupling engagement with the respective transport wheel 9 and 10. But at the same time, the springs 27 and 28 cause the formations 24 and 25 on the shafts to follow the pivoting motion of the cassette deck 4. The upshot thereof is that the freewheeling clutches 11 and 12 can be enabled or disabled selectively according to the function put in.

It is thus evident from FIG. 2 that when formation 25 has enabled freewheeling clutch 12, formation 24 has disabled freewheeling clutch 11. Accordingly, there would be no transport of the ribbon 6 when the correction tape 8 is at the typed line level. The set position of the rod 26 thus determines, in connection with the springs 27 and 28, which one of the freewheeling clutches 11 and 12 will be enabled.

As hereinbefore noted, to avoid unnecessary ribbon consumption incident to carriage movement associated with non-print functions in the print direction, e.g. space, tabulation, and paragraph indent, the mechanism serves to disable the normally engaged freewheeling clutch 11, despite motion of the carriage in the print direction 1. To accomplish this, the electronic control device for the rod 26 adjusts rod 26 so that the formations 24 and 25 assume intermediate elevated positions. Thus, at the intermediate elevated position with reference to FIG. 1, the formation 24 will be elevated beyond the freewheel 20 upwardly while the formation 25 will not reach the freewheel 21 from below. Accordingly, any transport step for the ribbon 6 and correction tape 8 can be avoided by lifting motion of the cassette deck 4 to an intermediate position between the FIG. 1 and FIG. 2 positions. This merely requires the control device for the rod 26 to be designed so that it raises the rod 26 to the intermediate elevated position upon the actuation, for example, of a spacing key, a tabulating key or other function command not associated with ribbon or tape movement. Thus, whenever such a function command is put into the machine, no transport step for the ribbon 6 or correction tape 8 would take place despite carriage motion in the direction in which the freewheel clutches are normally engaged.

As is obvious from the drawing and the description it is possible at little structural expense to control the mechanism so that, selectively, either the ribbon 6 or the correction tape 8 is transported, or neither of them in certain functions, even though the carriage 1 can freely move in the typing direction. If the carriage 1 moves in the opposite direction, no rotary motion whatever would be transmitted to the transport wheels 9, 10 anyway because the freewheeling clutches 11, 12 would then freewheel regardless of the axial position of formation 24, 25. The springs 27 and 28 of the freewheeling clutches 11 and 12 obviate a separate control of the shfts 22, 23 by means of an extra drive mechanism.

The invention claimed is:

1. A device for raising and transporting a print ribbon and a correction tape in a typewriter or the like, comprising a carriage adapted to be moved in print and return directions along a print line, a platform pivotally mounted on said carriage and mounting a print ribbon cartridge for said print ribbon and a correction tape cartridge for said correction tape, for movement from a rest position to first and second elevated positions to present said print ribbon and correction tape, respectively, at a printing line, a respective transport means for each of said cartridges to effect feed movement of the associated ribbon or tape, a first and a second freewheel clutch, each having a respective drive part, means for driving said drive parts of said first and second freewheel clutches incident to the movement of said carriage in said print direction, said first and second freewheel clutches each having a respective output part which in the rest position of said platform is normally decoupled from the associated one of said drive parts, means on each of said output parts for being activated to couple to and to selectively drive the respective transport means in said print ribbon and correction tape cartridges when each said associated output part is respectively driven, and means for moving said platform from said rest position to each of said elevated positions according to commanded functions, wherein movement to said first elevated position enables drive transmitting engagement of said output part of said first freewheel clutch with its associated drive part, whereby driving movement thereafter of said drive part of said first freewheel clutch in said print direction causes its associated output part to be driven thereby to transport said print ribbon and, wherein movement to said second elevated position of said platform disables the drive transmitting engagement of said drive and output parts of said first freewheel clutch and enables the drive transmitting engagement of said drive and output parts of said second freewheel clutch, whereby movement thereafter of said carriage in said print direction causes said drive part of said second clutch to transport said correction tape.

2. The device of claim 1, each said output part comprising a respective axially movable shaft, and a respective spring biasing each said shaft to follow the elevating movement of said platform to maintain coupling engagement with the associated transport means of said cartridges, and said shafts having at predetermined axial locations along the lengths thereof formations to enable the drive transmitting engagement of said associated drive and output parts.

3. The device of claim 1, wherein an intermediate position for said platform is provided, between said first and second elevated positions and at which both of said first and second freewheel clutches are disabled, said platform being movable to said intermediate position by said means for moving in accordance with said commanded functions.

4. The device of claim 1, comprising further means for controlling said feed movement of each of said ribbon and tape, wherein said print ribbon and said correction tape are each transported only when said platform is in the respective one of said first and second elevated positions and said carriage is moved in said print direction.

5. The device of claim 3, comprising further means for controlling said feed movement of each of said ribbon and tape, wherein said print ribbon and said correction tape are each transported only when said platform is in the respective one of said first and second elevated positions and said carriage is moved in said print direction.

* * * * *